US008888237B2

(12) United States Patent
Kondo et al.

(10) Patent No.: US 8,888,237 B2
(45) Date of Patent: Nov. 18, 2014

(54) LIQUID JETTING APPARATUS

(75) Inventors: Hirofumi Kondo, Tajimi (JP); Shuhei Hiwada, Toyoake (JP); Masato Sueyasu, Nagoya (JP); Yasuhiro Kato, Nagoya (JP); Reiko Higashikawa, Iwakura (JP); Tomoyuki Kubo, Nagoya (JP); Toru Yamashita, Nagoya (JP); Shigeru Suzuki, Nagoya (JP); Hiroto Sugahara, Ama (JP); Masayoshi Hayashi, Nagoya (JP); Tatsuya Nishikawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 90 days.

(21) Appl. No.: 13/587,066

(22) Filed: Aug. 16, 2012

(65) Prior Publication Data

US 2013/0076827 A1 Mar. 28, 2013

(30) Foreign Application Priority Data

Sep. 27, 2011 (JP) ..... 2011-210669

(51) Int. Cl.
*B41J 2/165* (2006.01)

(52) U.S. Cl.
USPC ..... 347/36; 347/34; 347/86

(58) Field of Classification Search
USPC ..... 347/19, 27, 35, 36, 34, 85, 86
IPC ..... B41J 2002/1728,2002/1856
See application file for complete search history.

(56) References Cited

U.S. PATENT DOCUMENTS

| | | | | |
|---|---|---|---|---|
| 5,953,031 | A * | 9/1999 | Omata et al. | 347/86 |
| 2005/0151782 | A1 | 7/2005 | Ishida et al. | |
| 2009/0189947 | A1 * | 7/2009 | Noro et al. | 347/36 |
| 2010/0165040 | A1 | 7/2010 | Ohnishi et al. | |

FOREIGN PATENT DOCUMENTS

| | | |
|---|---|---|
| JP | 2002-127464 | 5/2002 |
| JP | 2004-249597 | 9/2004 |
| JP | 2006-035662 | 2/2006 |
| JP | 2010-155411 | 7/2010 |

* cited by examiner

*Primary Examiner* — Lam S Nguyen
(74) *Attorney, Agent, or Firm* — Frommer Lawrence & Haug LLP

(57) ABSTRACT

There is provided a liquid jetting apparatus including: a liquid jetting head configured to jet liquid; a liquid discharge unit configured to discharge the liquid from the liquid jetting head; a waste liquid recover unit including a waste liquid absorber configured to absorb a waste liquid discharged from the liquid jetting head by the liquid discharge unit and detection electrodes configured to detect a waste liquid amount absorbed into the waste liquid absorber; and a vibration generating source configured to vibrate the waste liquid absorber in a vibration direction, wherein the detection electrodes are disposed to make contact with an end surface defining the waste liquid absorber, and a normal direction of the end surface intersects with the vibration direction.

12 Claims, 11 Drawing Sheets

LIQUID JETTING APPARATUS

CROSS REFERENCE TO RELATED APPLICATION

The present application claims priority from Japanese Patent Application No. 2011-210669, filed on Sep. 27, 2011, the disclosure of which is incorporated herein by reference in its entirety.

BACKGROUND OF THE INVENTION

1. Field of the Invention

The present invention relates to a liquid jetting apparatus which jets liquid droplet 2. Description of the Related Art Some conventional liquid jetting apparatuses to jet liquid such as liquid droplets include a waste liquid recovery unit recovering liquid (hereinafter referred to also as "waste liquid") discharged from a liquid jetting head during maintenance etc. The waste liquid recovery unit of general type has an absorber or absorbing member which absorbs the waste liquid and is formed of a porous material such as a sponge. Further, there is also a waste liquid recovery unit provided with a sensor to detect a waste liquid amount absorbed into the absorber.

For example, an ink-jet printer which jets ink on a recording medium to record an image is disclosed in FIG. 2 of Japanese Patent Application laid-open No. 2004-249597. This ink-jet printer includes a waste liquid tray, in which the absorber is accommodated, on a lower side of a platen. A waste ink detector provided with a pair of electrodes is attached to the waste liquid tray; and the pair of electrodes is inserted into the absorber. The waste ink detector detects a full-liquid state of the absorber by using a decrease of electrical resistance between the electrodes occurred when the waste liquid is absorbed into a portion of the absorber between the pair of the electrodes. Noted that the full-liquid state of the absorber refers to a state in which no waste liquid can be absorbed into the absorber any more.

SUMMARY OF THE INVENTION

In the ink-jet printer as described above, the pair of electrodes of the waste ink detector is inserted into the absorber. However, in such a construction, there is fear that holes, of the absorber, through which the electrodes are inserted, gradually get bigger due to vibration generated when the ink-jet printer is used. The bigger the holes are, the bigger gaps between the absorber and the electrodes are. Then, it becomes difficult that the waste liquid absorbed into the absorber makes contact with the electrodes. Therefore, in some cases, it may be caused such a situation that the full-liquid state can not be detected.

Further, the longer a period of use of the ink-jet printer is, the more likely that the holes, of the absorber, through which the electrodes are inserted, get bigger due to the vibration applied to the ink-jet printer for the long period of time. Thus, an occurrence rate of the detection failure as described above increases. By the way, the detection of the full-liquid state by the waste ink detector is performed to detect as to whether or not the absorber is in the full-liquid state in a case that an entire amount of the absorbed waste liquid becomes larger due to the long-term usage of the ink-jet printer. However, if the occurrence rate of the detection failure of the waste liquid becomes higher in proportion to the period of use of the ink-jet printer, there is fear that the detection of the full liquid state can not be performed at a time at which the detection is actually required.

In view of the above, an object of the present teaching is to provide a liquid jetting apparatus in which a contact state between detection electrodes for detecting a waste liquid amount recovered by an absorber and the absorber can be maintained for a long period of time.

According to an aspect of the present teaching, there is provided a liquid jetting apparatus which jets liquid onto a medium, including:

a liquid jetting head configured to jet the liquid;

a liquid discharge unit configured to discharge the liquid from the liquid jetting head;

a waste liquid recover unit including a waste liquid absorber configured to absorb a waste liquid discharged from the liquid jetting head by the liquid discharge unit and detection electrodes configured to detect a waste liquid amount absorbed into the waste liquid absorber; and a vibration generating source configured to vibrate the waste liquid absorber in a vibration direction, wherein the detection electrodes are disposed to make contact with an end surface defining the waste liquid absorber, and a normal direction of the end surface intersects with the vibration direction.

The liquid jetting apparatus of the present teaching is configured so that the detection electrodes are brought in contact with the end surface of the waste liquid absorber. Since the detection electrodes make contact with the absorber over a large area, the contact state between the detection electrodes and the absorber is more likely to be maintained. The vibration generating source which vibrates the waste liquid absorber is exemplified, for example, by a head driving mechanism which moves the liquid jetting head in a scanning direction. In this case, the end surface of the waste liquid absorber with which the detection electrodes are in contact can be, for example, an end surface along the scanning direction which is the moving direction of the liquid jetting head. Even when the vibration in a direction parallel to the scanning direction acts on the waste liquid recover unit due to the movement of the liquid jetting head, the direction of this vibration is a direction along the end surface with which the detection electrodes are in contact. That is, vibrational component in a direction in which the detection electrodes are separated from the waste liquid absorber (a direction perpendicular to the end surface) is small and the contact state between the detection electrodes and the waste liquid absorber can be maintained for a long time.

Further, as another example of the vibration generating source, it can be cited a cover which is rotatably attached to a housing. In this case, the end surface of the waste liquid absorber with which the detection electrodes are in contact can be an end surface along a rotating direction of the cover. Thus, the vibrational component in the direction in which the detection electrodes are separated from the waste liquid absorber is small and the contact state between the detection electrodes and the waste liquid absorber can be maintained for a long time.

Further, as still another example of the vibration generating source, it can be cited a rotating mechanism which rotates, in an up-down direction relative to the housing, the waste liquid recover unit disposed at a position over or above the liquid jetting head. In this case, the waste liquid recover unit can be configured to be retractable from the position above the liquid jetting head; and the end surface of the waste liquid absorber with which the detection electrodes are in contact can be an end surface parallel to the up-down direction which is the rotating direction of the waste liquid recover unit. Thus, the vibrational component in the direction in which the detection electrodes are separated from the waste liquid absorber is small and the contact state between the detection electrodes and the waste liquid absorber can be maintained for a long time.

DESCRIPTION OF THE PREFERRED EMBODIMENTS

Figure 1:
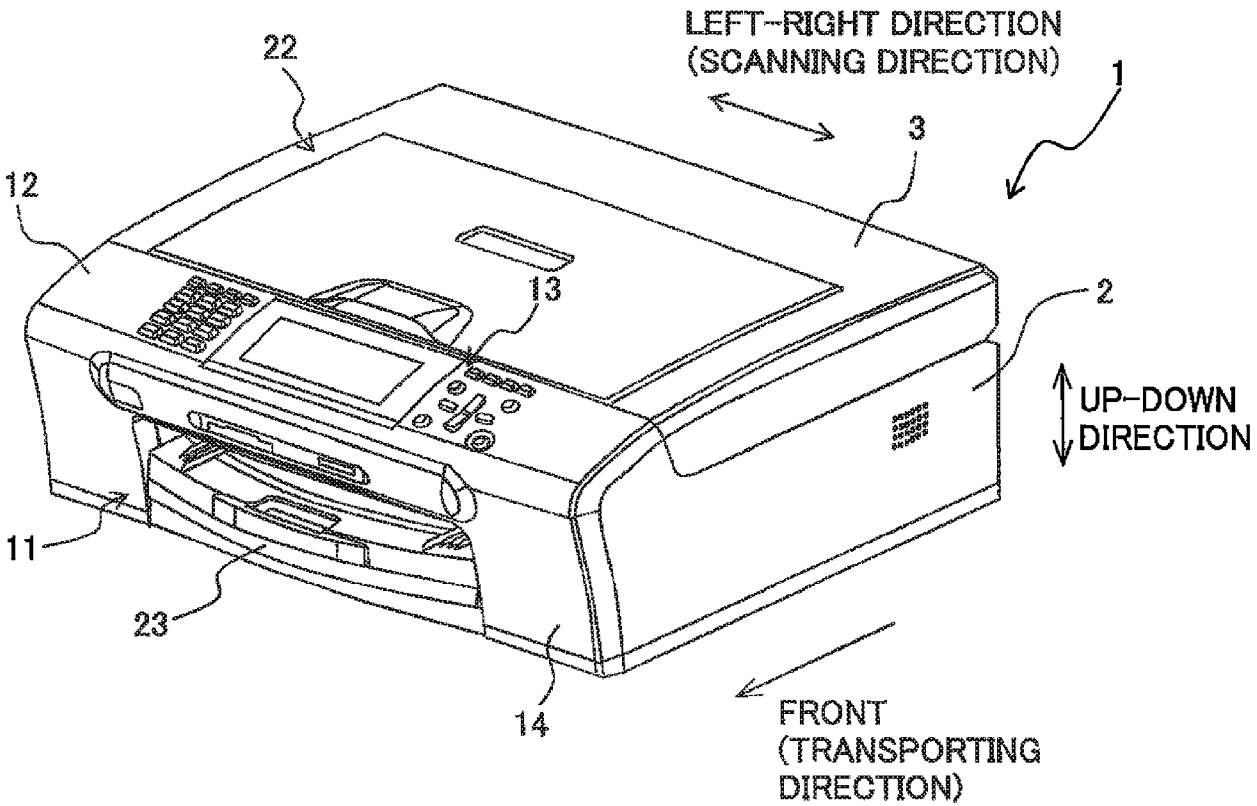
FIG. 1 is a perspective view of an ink-jet printer according to this embodiment.

Next, an embodiment of the present teaching will be explained. In FIG. 1, an up-down direction, a left-right direction, and a front-rear direction are respectively defined in an installed state of an ink-jet printer as shown in FIG. 1.

As shown in FIG. 1, an ink-jet printer 1 (liquid droplet jetting apparatus) includes a printer housing 2 and a cover 3 rotatably attached to the printer housing 2.

[Printer Housing]

Figure 2:
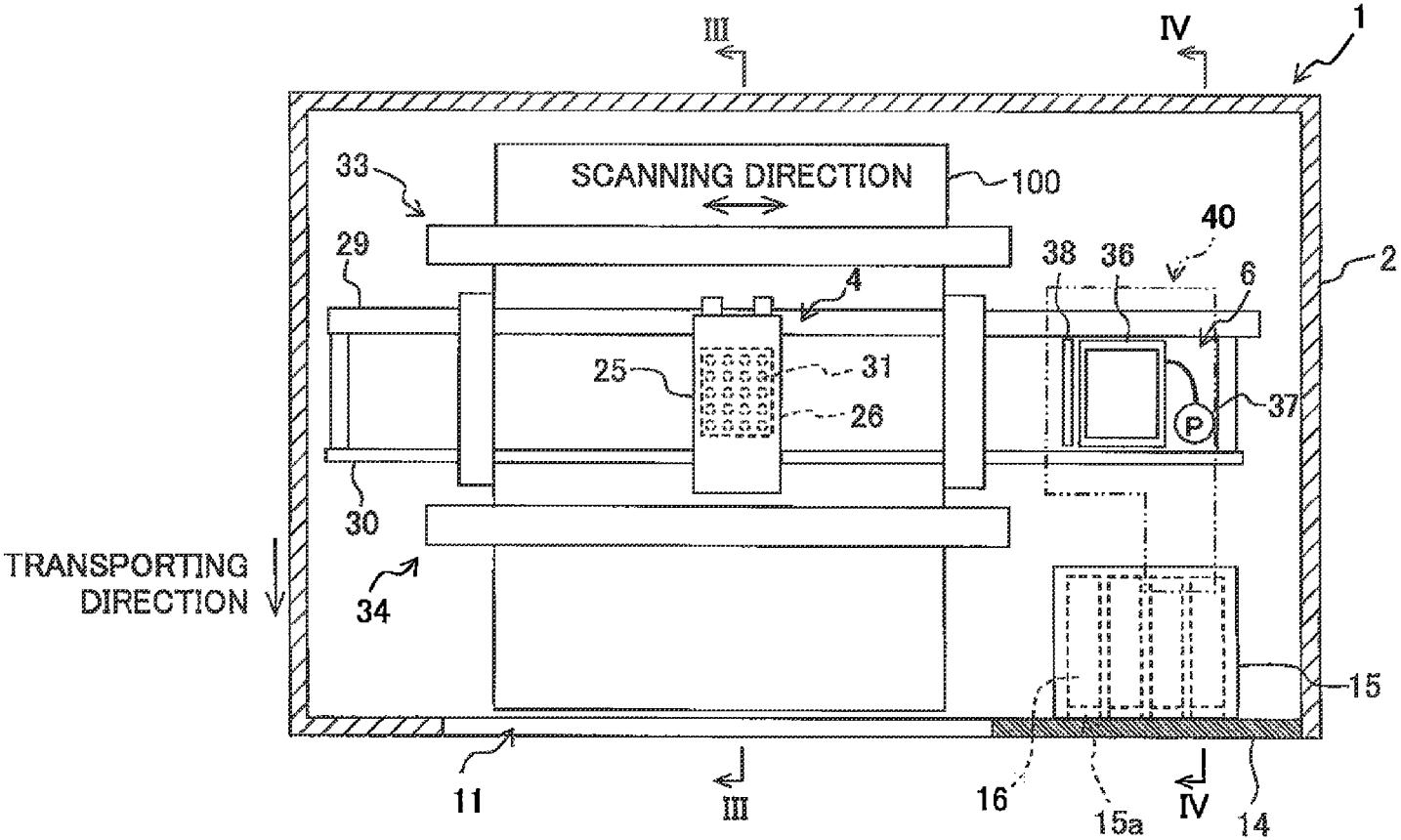
FIG. 2 is a plan view schematically showing an internal structure of the ink-jet printer of FIG. 1.
Figure 3:
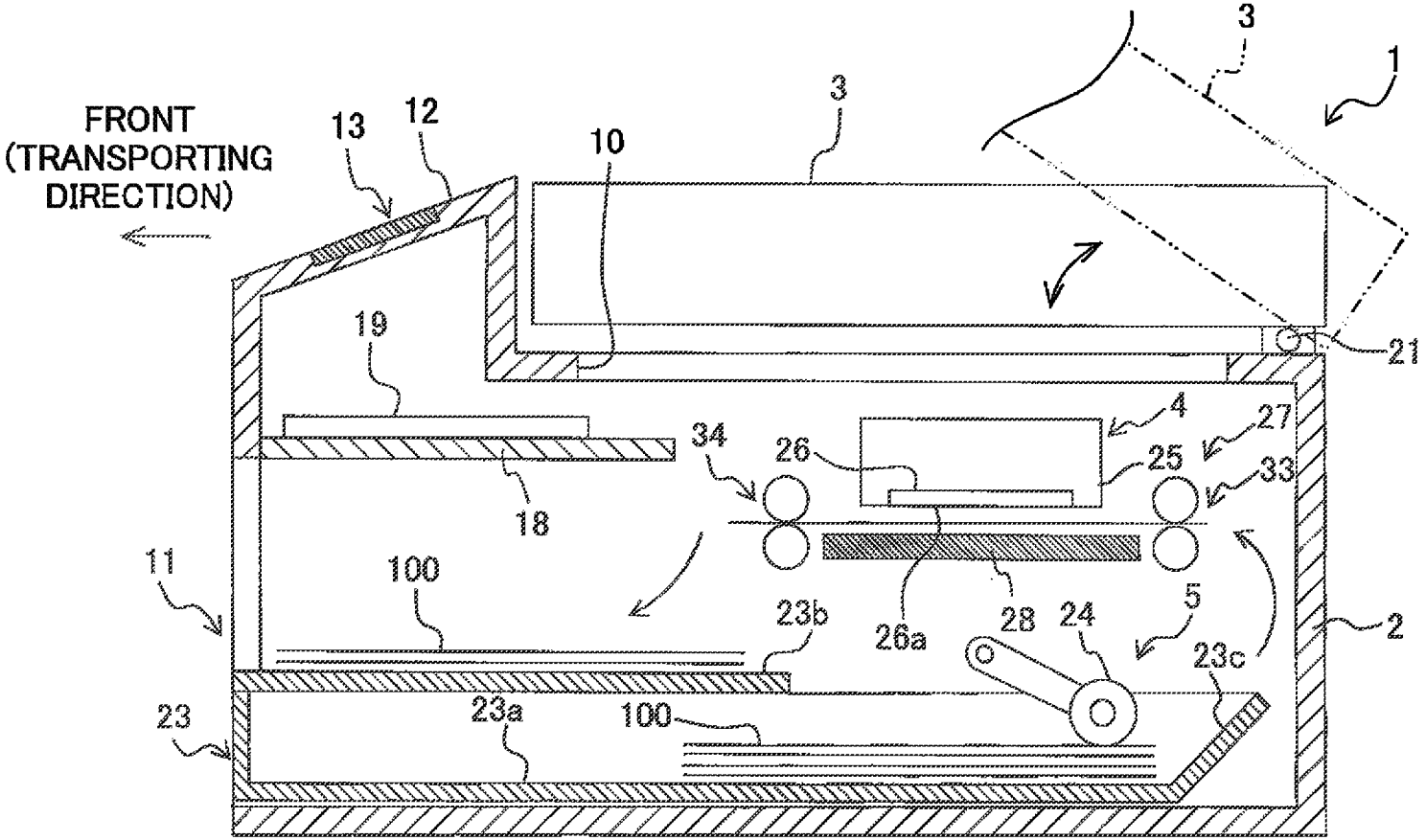
FIG. 3 is a vertical cross-sectional view of the ink-jet printer taken along line III-III in FIG. 2.
Figure 4:
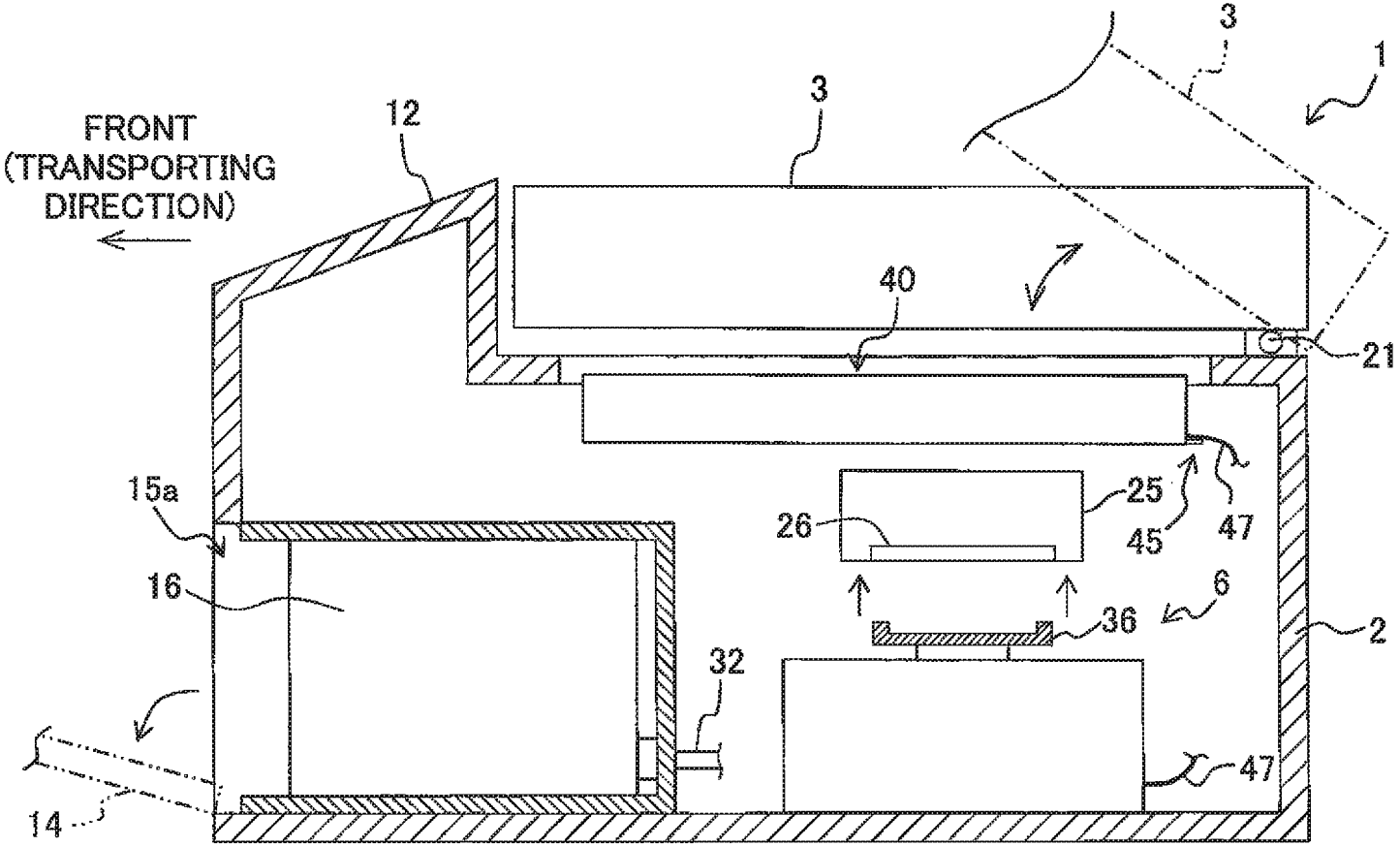
FIG. 4 is a vertical cross-sectional view of the ink-jet printer taken along line IV-IV in FIG. 2.

As shown in FIGS. 2 to 4, a printer section 4 which is configured to record an image on a recording paper sheet 100, a paper feeding mechanism 5 which is configured to supply the recording paper sheet 100 to the printer section 4, and a maintenance unit 6 which is configured to perform maintenance of an ink jet head 26 of the printer section 4 are accommodated in the printer housing 2.

As shown in FIG. 3, an opening 10 for the paper jam clear process and the maintenance is formed at an upper-end portion of the printer housing 2, and an install section 11 to which a paper feeding cassette 23 of the paper feeding mechanism 5 is installed is provided at a front-end portion of the printer housing 2. Further, an inclined surface 12, which is inclined frontward, is provided at the upper-end portion of the printer housing 2, on a front-side of the opening 10. In the inclined surface 12, there is arranged a display operation section 13 including a display panel, operation buttons, etc.

An access cover 14 which is openable and closable is attached on a right side of the install section 11 of the printer housing 2. A holder 15 to which ink cartridges 16 are installed is disposed on the far side of the access cover 14. The holder 15 includes four cartridge installing sections 15*a*. Four ink cartridges 16, in which inks of four colors (black, yellow, cyan, and magenta) are stored respectively, are removably installed to the four cartridge installing sections 15*a*, respectively.

As shown in FIGS. 3 and 4, the printer housing 2 has a board support section 18 which horizontally extends from an inner surface of a front wall of the printer housing 2. A control board 19, in which various circuits in relation to control of the ink-jet printer 1 are incorporated, is supported by the board support section 18.

[Cover]

The cover 3 is disposed on a rear side of the inclined surface 12 of the printer housing 2 and is attached to be rotatable up and down around a rotational axis 21 provided at a rear-end portion of the cover 3. The cover 3 is capable of changing positions thereof between a horizontal close position, in which the opening 10 of the printer housing 2 is covered and closed by the cover 3, and an open position in which the cover 3 is rotated upward from the close position. That is, the cover 3 is rotatable between a position shown by solid lines in FIG. 3 and a position shown by two-dot lines in FIG. 3. Further, although any detailed explanation is omitted, the cover 3 is provided with a scanning section 22 including an image scanner which is configured to scan the image etc., recorded on a document; and the ink-jet printer 1 of this embodiment is configured as a multifunction machine which is capable of executing printing, scanning, copying, etc. Noted that it is not indispensable that the present teaching is applied to the multifunction machine. For example, the present teaching may be applied to a printer including the printer function only.

[Paper Feeding Mechanism]

As shown in FIG. 3, the paper feeding mechanism 5 includes the paper feeding cassette 23 which is installed to the install section 11 of the printer housing 2 and a pickup roller 24 which picks up the recording paper sheet 100 from the paper feeding cassette 23. The paper feeding cassette 23 includes a main tray 23*a* in which stacked recording paper sheets 100 are stored and a paper discharge tray 23*b* which is disposed over or above the main tray 23*a* and onto which the recording paper sheet 100, for which recording has been performed by the printer section 4 as will be described later on, is discharged. The pickup roller 24 is arranged over or above the main tray 23*a* and is configured to be rotatable around the rotational axis provided in the printer housing 2. The pickup roller 24 is driven by a paper feeding motor 56 (see FIG. 5) to take the recording paper sheets 100 one-by-one from the main tray 23*a* of the paper feeding cassette 23. The recording paper sheet 100 taken by the pickup roller 24 is pushed upward along a sloped surface 23*c* provided at the front-end portion of the paper feeding cassette 23 and then is supplied to the printer section 4.

[Printer Section]

The printer section 4 is disposed over or above the paper feeding mechanism 5. As shown in FIGS. 2 and 3, the printer section 4 includes a carriage 25 which is reciprocatively movable in the left-right direction (scanning direction), the ink-jet head (liquid jetting head) 26 carried on the carriage 25, a transporting mechanism 27 to transport the recording paper sheet 100 in the frontward direction (transporting direction) along the horizontal surface, etc.

Figure 5:
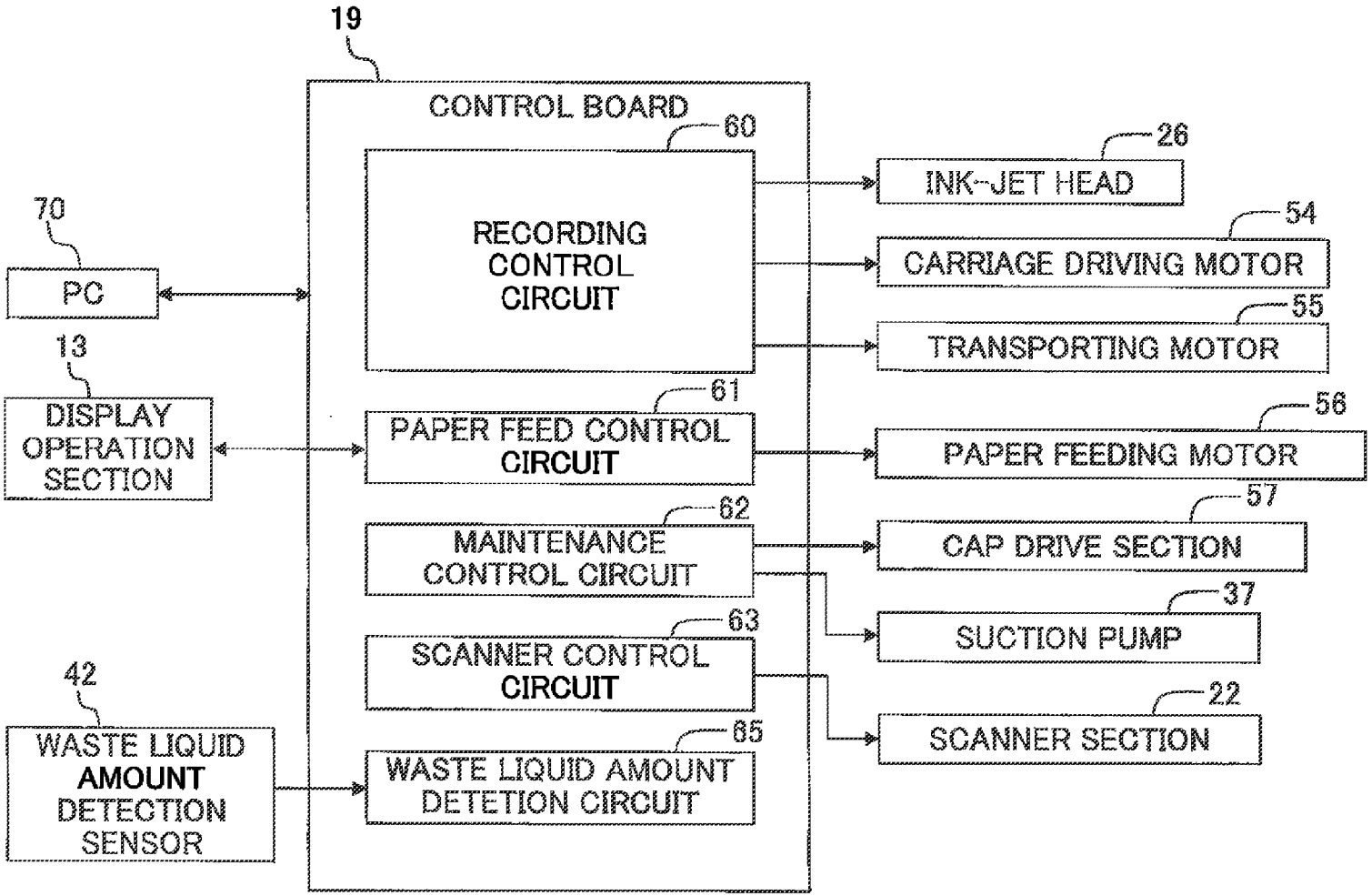
FIG. 5 is a block diagram schematically showing an electrical structure of the ink-jet printer.

A platen 28, which is configured to support the recording paper sheet 100, is provided in a horizontal posture in the printer housing 2. As shown in FIG. 2, two guide rails 29, 30 extending parallel in the scanning direction are provided over or above the platen 28. The carriage 25 is driven by a carriage driving motor 54 as shown in FIG. 5 to move in the scanning direction along the two guide rails 29, 30 in an area facing the recording paper sheet 100 on the platen 28.

The ink-jet head 26 is attached to a lower portion of the carriage 25 in a state that a gap is provided between the ink-jet head 26 and the platen 28. A plurality of nozzles 31 are formed on the lower surface of the ink-jet head 26. That is, the lower surface of the ink-jet head 26 is a liquid droplet jetting surface 26*a*. The nozzles 31 are aligned in the transport direction to form four nozzle arrays through which the inks of four colors (black, yellow, cyan, and magenta) are jetted respectively. Further, the ink-jet head 26 carried on the carriage 25 is connected to the holder 15 via four tubes 32 (see FIG. 4). The inks of four colors in the four ink cartridges 16 installed to the holder 15 are supplied to the ink-jet head 26 via the four tubes 32, respectively.

Further, the ink-jet head 26 is movable, together with the carriage 25, not only in a range in which the ink-jet head 26 faces the recording paper 100 transported on the platen 28 but also to outsides of said range in the left-right direction. In particular, as shown in FIGS. 2 and 4, a position on a right side of the range facing the recording paper sheet 100 is a waiting position at which the carriage 25 is positioned in a case that the ink-jet head 26 is not used. When the ink-jet head 26 arrives at the waiting position, the ink-jet head 26 is opposed to the maintenance unit 6, as will be described later on, which is disposed on the lower side of the ink-jet head 26.

The transport mechanism 27 includes two pairs of transporting rollers 33, 34 which are disposed on opposite sides of the platen 28 to interpose the platen 28 and the carriage 25 in the transport direction. The respective two pairs of transporting rollers 33, 34 are driven by a transporting motor 55 as shown in FIG. 5 to transport the recording paper sheet 100 between the ink-jet head 26 and the platen 28 in the frontward direction (transporting direction).

The printer section 4 is configured so that the ink is jetted to the recording paper sheet 100 on the platen 28 from the ink-jet head 26 while moving the carriage 25 in the scanning direction (left-right direction of FIG. 1). Further, the printer section 4 is configured so that a desired image, letters, and the like, are recorded on the recording paper sheet 100 by transporting the recording paper sheet 100 in the transporting direction by the two pairs of transport rollers 33, 34.

[Maintenance Unit]

As shown in FIG. 2, the maintenance unit 6 is disposed at a position on the right side of the platen 28. That is, the maintenance unit 6 is disposed at a position to face the ink-jet head 26 positioned at the waiting position. The maintenance unit 6 includes, for example, a maintenance base 35 fixed to the bottom surface of the printer housing 2, a cap member 36, a suction pump 37, and a wiper 38, those of which are attached to the maintenance base 35.

The cap member 36 is driven to make contact with and separate from the liquid droplet jetting surface 26*a* of the ink-jet head 26 by a cap driving section 57, as shown in FIG. 5, which is constructed of a driving source such as a motor and a power transmission mechanism such as a gear. The cam member 36 comes into close contact with the liquid droplet jetting surface 26*a* of the ink-jet head 26 to cover the openings of the nozzles 31 (capping). The suction pump 37 is connected to the cap member 36 and is capable of sucking the air in the cap member 36 to reduce the pressure in the cap member 36 in a state that the cap member 36 comes into close contact with the liquid droplet jetting surface 26*a* of the ink-jet head 26. Accordingly, it is possible to perform a suction purge in which the ink is forcibly discharged into the cap member 36 from the nozzles 31.

By performing the suction purge, bubbles and/or dust mixed in the ink, viscosity-increased ink, and the like are discharged. Thus, it is possible to prevent occurrence of jetting failure of the nozzles 31, and at the same time, it is possible to recover the jetting performance when the jetting failure occurs. The ink discharged into the cap member 36 from the nozzles 31 by the suction purge (hereinafter referred to also as waste liquid) is recovered by a waste liquid recover unit 40, as will be described later on, which is connected to the maintenance base 35 via a waste liquid tube 47. Noted that the cap member 36 and the suction pump 37 connected to the cap member 36 each correspond to a liquid discharge unit of the present teaching which discharges the ink from the ink-jet head 26.

Further, the wiper 38 is provided on a left side of the cap member 36. In a case that the ink-jet head 26 moves toward the platen 28 from the waiting position after the suction purge, the wiper 38 wipes the ink adhered on the liquid droplet jetting surface 26*a*.

[Waste Liquid Recover Unit]

Figure 6A:
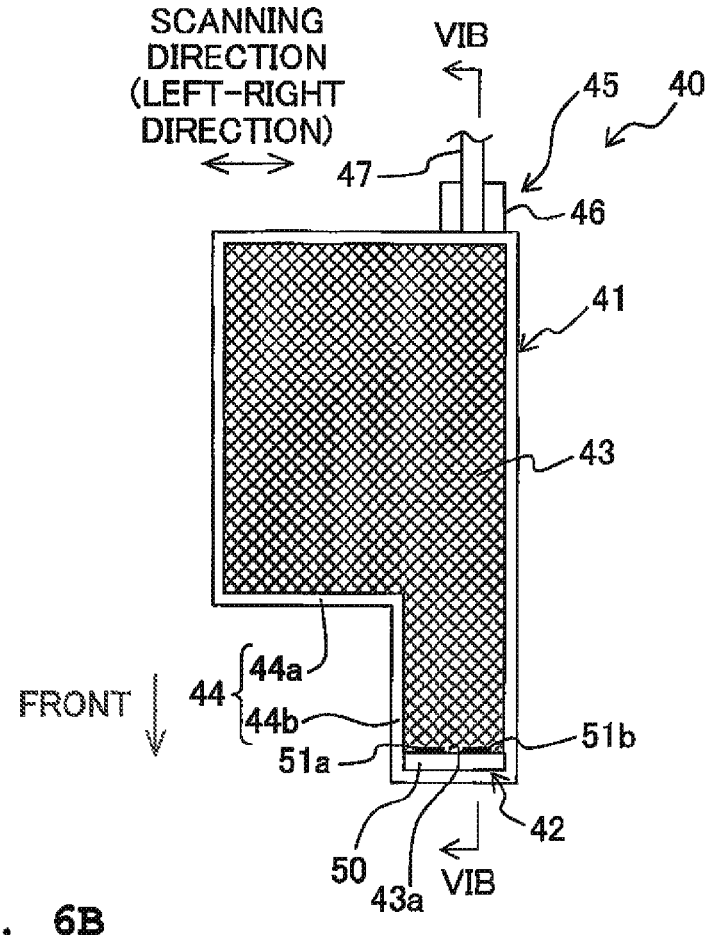
FIG. 6A is a plan view of a waste liquid recover unit.

The waste liquid recover unit 40 is arranged at a position over or above the maintenance unit 6 in the printer housing 2, that is, at a position over or above the ink-jet head 26 positioned at the waiting position, as depicted by two-dot lines in FIG. 2. As shown in FIG. 6A, the waste liquid recover unit 40 is connected to the maintenance unit 6 via the waste liquid tube 47. The waste liquid recover unit 40 includes a waste liquid recover portion 41 provided with a waste liquid foam 43 recovering the waste liquid and a waste liquid amount detection sensor 42 which detects a waste liquid amount recovered into the waste liquid recover portion 41. The construction of the waste liquid recover unit 40 will be specifically described later.

[Electrical Structure of Printer]

As shown in FIG. 5, the ink-jet printer 1 includes the control board 19 which controls operation of constitutive parts or components of the ink-jet printer 1. Various signals in relation to recording operation are inputted to the control board 19 from a PC 70 as an external unit and the display operation section 13.

Various circuits including, for example, a record control circuit 60 which controls the recording operation by the ink-jet head 26 etc., a paper feed control circuit 61 which controls paper feed operation by the paper feeding mechanism 5, a maintenance control circuit 62 which controls maintenance operation, such as the suction purge, by the maintenance unit 6, and a scanner control circuit 63 which controls image scanning operation by the scanning section 22, are incorporated in the control board 19.

Further, a waste liquid amount detection circuit 65, which detects the waste liquid amount recovered into the waste liquid foam 43 of the waste liquid recover portion 41 based on a detection signal outputted from the waste liquid amount detection sensor 42 of the waste liquid recover unit 40 as will be described later on, is also incorporated in the control board 19. Then, in a case that the waste liquid amount detection circuit 65 detects that the waste liquid amount recovered into the waste liquid foam 43 exceeds a certain amount, the control board 19 sends, to the display operation section 13 or the PC 70, a signal indicating that the waste liquid foam 43 is substantially in a full-liquid state to display a warning message for encouraging an exchange of the waste liquid foam 43 on the display operation section 13 or the PC 70.

[Details of Waste Liquid Recover Unit]

Next, an explanation will be made in detail about the construction of the waste liquid recover unit 40. As shown in FIG. 6, the waste liquid recover unit 40 includes the waste liquid recover portion 41 and the waste liquid amount detection sensor 42 to detect the waste liquid amount recovered into the waste liquid recover portion 41.

Figure 6B:
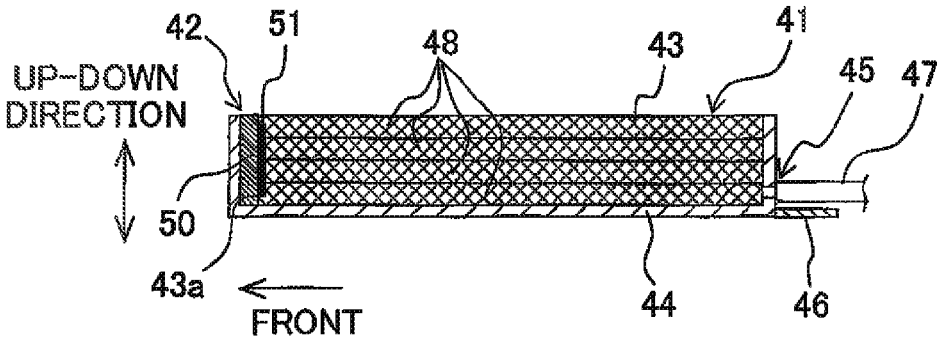
FIG. 6B is a cross-sectional view taken along line XIB-XIB in FIG. 6A.

The waste liquid recover portion 41 includes the waste liquid foam 43 (waste liquid absorber) which absorbs the waste liquid and a waste liquid case 44 which accommodates the waste liquid foam 43. As shown in FIG. 6A, the waste liquid case 44 includes a main accommodating portion 44*a* which is rectangular as viewed in a plan view and a protruding accommodating portion 44*b* which protrudes frontward from the main accommodating portion 44*a*. As shown in FIG. 6B, the waste liquid foam 43 has a configuration in which a plurality of absorber sheets 48, each of which is made of a porous material, are stacked vertically, and the waste liquid foam 43 is filled over entire areas of the main accommodating portion 44*a* and the protruding accommodating portion 44*b*.

A rear-end portion of the main accommodating portion 44*a* of the waste liquid case 44 is a waste liquid inlet portion 45 connected to the maintenance base 35 via the waste liquid tube 47. The waste liquid generated in the maintenance unit 6 is introduced into the waste liquid case 44 from the waste liquid inlet portion 45 and then is absorbed into the waste liquid foam 43. Noted that a waste liquid receiver 46, which horizontally protrudes from a rear-end surface on which the waste liquid inlet portion 45 is provided and receives the waste liquid leaked from the waste liquid inlet portion 45, is provided in the waste liquid case 44 on a lower side of the waste liquid inlet portion 45.

The waste liquid amount detection sensor 42 includes a board 50 made of an insulating material and detection electrodes 51 formed on the surface of the board 50. The board 50 is inserted into a gap between an inner wall surface of the waste liquid case 44 and a front-end surface 43*a* of the waste liquid foam 43 in the front-end portion of the protruding accommodating portion 44*b*. The detection electrodes 51 formed on the board are brought in contact with the front-end surface 43*a* of the waste liquid foam 43.

As shown in FIG. 6, the board 50 is provided with an input-side detection electrode 51*a* to which an input signal is inputted from the waste liquid amount detection circuit 65 (see FIG. 5) mounted on the control board 19 and an output-side detection electrode 51*b* from which a detection signal is outputted to the waste liquid amount detection circuit 65. In an example of electrode patterns of the detection electrodes 51*a*, 51*b* shown in FIG. 7, the two detection electrodes 51*a*, 51*b* are constructed of two kinds of elongated electrode patterns which are arranged alternately and parallel to each other along the front-end surface 43*a* of the waste liquid foam 43. One end portions of the detection electrodes 51*a*, 51*b* are pulled out or drawn to a back surface side from through holes 50*a*, 50*b*, respectively; and the respective one end portions are connected to the control board 19 (waste liquid amount detection circuit 65; see FIG. 5). On the other hand, the other end portions of the detection electrodes 51*a*, 51*b* are connected to each other via a capacitor C.

In a case that the waste liquid amount absorbed into the waste liquid foam 43 is small, the waste liquid is absorbed only into a portion, of the waste foam 43, close to the waste liquid inlet portion 45; and the waste liquid does not arrive at a portion, of the waste foam 43 in the protruding accommodating portion 44*b*, separated from the waste liquid inlet portion 45. With an increase of the waste liquid amount, the waste liquid is absorbed also into the portion, of the waste foam 43 in the protruding accommodating portion 44*b*, separated from the waste liquid inlet portion 45. In a case that the absorbed waste liquid amount exceeds the certain amount, the waste liquid makes contact with the detection electrodes 51*a*, 51*b* of the waste liquid amount detection sensor 42 which are arranged furthest from the waste liquid inlet portion 45. In this situation, if a short circuit between the two detection electrodes 51*a*, 51*b* extending parallel to each other is caused by the waste liquid having conductivity, the detection signal outputted from the output-side detection electrode 51*b* changes. By detecting the change of the detection signal by the waste liquid amount detection circuit 65, it is detected as to whether or not the waste liquid amount absorbed into the waste liquid foam 43 exceeds the certain amount.

By the way, as described above, the board 50 of the waste liquid amount detection sensor 42 is inserted between the front-end surface 43*a* of the waste liquid foam 43 and the waste liquid case 44; and the detection electrodes 51*a*, 51*b* are brought in contact with the front-end surface 43*a* of the waste liquid foam 43. In this construction, the detection electrodes 51*a*, 51*b* are brought in contact with the waste liquid foam 43 over a large area. Thus, the contact state between the detection electrodes 51*a*, 51*b* and the waste liquid foam 43 is more likely to be maintained, However, if the detection electrodes 51*a*, 51*b* are separated from the end surface of the waste liquid foam 43 due to various vibrations generated in the printer 1, the waste liquid is less likely to contact with the detection electrodes 51*a*, 51*b*. Thus, reliability of the detection of the waste liquid amount is decreased. In the ink-jet printer 1 of this embodiment, however, the detection electrodes 51*a*, 51*b* are brought in contact with the front-end surface 43*a* of the waste liquid foam 43, and the detection electrodes 51*a*, 51*b* are less likely to be separated from the waste liquid foam 43, as compared with a case in which the detection electrodes 51*a*, 51*b* are formed on an end surface other than the front-end surface 43*a*. The reason thereof is considered as follows.

A factor causing the vibration in the ink-jet printer 1 is exemplified, at first, by reciprocative movement in the scanning direction of the carriage 25, on which the ink-jet head 26 is carried, at the time of recording of the image. When the carriage 25 is moved, the vibration along the movement direction of the carriage 25, that is, the vibration in the left-right direction (scanning direction) mainly acts on the ink-jet printer 1. This vibration is relatively large as compared with other vibrations generated in the ink-jet printer 1. Further, since the carriage 25 moves every time when the recording of the image is performed, frequency of the occurrence of this vibration is very high. However, the front-end surface 43*a* of the waste liquid foam 43 with which the detection electrodes 51*a*, 51*b* are in contact is an end surface along the scanning direction, and the vibration acting on the waste liquid foam 43 at the time of the movement of the carriage 25 generates in a direction along the end surface with which the detection electrodes 51*a*, 51*b* are in contact. Accordingly, the board 50, in which the detection electrodes 51*a*, 51*b* are formed, may deviate or shift in a plane direction with respect to the waste liquid foam 43. In other words, the detection electrodes 51*a*, 51*b* may deviate or shift with respect to the waste liquid foam 43 within a same plane. However, the detection electrodes 51, 51*b* are less likely to be separated from the waste liquid foam 43.

Further, another factor causing the vibration in the ink-jet printer 1 is exemplified by a rotating operation of the cover 3. In this embodiment, the cover 3 is provided with the scanning section 22 and is relatively heavy in weight. In particular, a large impact is generated at a moment that the closed cover 3 is opened or that the opened cover 3 is completely closed, and thereby the vibration propagetes throughout the ink-jet printer 1. However, the front-end surface 43*a* of the waste liquid foam 43 with which the detection electrodes 51*a*, 51*b* are in contact is an end surface which is parallel to the up-down direction. Here, a rotating direction of the cover 3 immediately after the rotating operation to open the cover 3 is started is the up-down direction. Similarly, a rotating direction of the cover 3 immediately before the rotating operation to close the cover 3 is completed is also the up-down direction. In other words, the direction of the vibration acting on the waste liquid foam 43 at the time of opening/closing of the cover 3 is substantially parallel to the direction along the end surface with which the detection electrodes 51*a*, 51*b* are in contact. Therefore, the detection electrodes 51, 51*b* are less likely to be separated from the waste liquid foam 43. Noted that the rotating direction of the cover 3 means a tangential direction of a locus which is drawn by an end portion on a side opposite to the rotational axis 21 of the cover 3 when the cover 3 is rotated around the rotational axis 21. As described above, in the case that the ink-jet printer 1 is placed horizontally, the rotating direction of the cover 3 immediately after the rotating operation to open the cover 3 is started and immediately before the rotating operation to close the cover 3 is completed is the up-down direction. In the following description, except where specifically noted, the rotating direction of the cover 3, of when the ink-jet printer 1 is placed horizontally, immediately after the rotating operation to open the cover 3 is started and immediately before the rotating operation to close the cover 3 is completed is referred to simply as the rotating direction of the cover 3.

As described above, the front-end surface 43*a* of the waste liquid foam 43 with which the detection electrodes 51*a*, 51*b* are in contact is an end surface along a direction of each of the major vibrations generated in the ink-jet printer 1. Thus, vibrational component in a direction in which the detection electrodes 51*a*, 51*b* are separated from the waste liquid foam 43, that is, vibrational component in a direction perpendicular to the end surface is small, and the contact state between the detection electrodes 51*a*, 51*b* and the waste liquid foam 43 can be maintained for a long time.

As for the waste liquid case 44, there is fear that the waste liquid is leaked to the outside, in particular, from the waste liquid inlet portion 45 connected to the tube 47 due to the vibration generated in the ink-jet printer 1 as described above. If the waste liquid leaked from the waste liquid inlet portion 45 is adhered to the detection electrodes 51*a*, 51*b*, misdetection may occur. In this embodiment, however, the waste liquid inlet portion 45 of the waste liquid recover unit 40 is provided at the rear-end portion of the waste liquid case 44, that is, on a side of the end surface, of the waste liquid foam 43, opposite to the detection electrodes 51*a*, 51*b*. Thus, even when the waste liquid is leaked from the waste liquid inlet portion 45, the waste liquid is less likely to be adhered to the detection electrodes 51*a*, 51*b*.

In this embodiment, the waste liquid recover unit 40 is configured as follows. That is, the detection electrodes 51*a*, 51*b* are formed on the surface of the insulating board 50. The board 50 is arranged along the front-end surface 43*a* of the waste liquid foam 43 so that the detection electrodes 51*a*, 51*b* make contact with the waste liquid foam 43. In this construction, the detection electrodes 51*a*, 51*b* are interposed between the board 50 and the waste liquid foam 43, and thus the detection electrodes 51*a*, 51*b* are not exposed outside. Accordingly, it is possible to reduce a risk such as damage and/or exfoliation of the detection electrodes 51*a*, 51*b*. Or, since there is no possibility that the waste liquid leaked from the waste liquid inlet portion 45 and/or the liquid such as mist of the ink floating in the surroundings is/are adhered to the detection electrodes 51*a*, 51*b*, the occurrence of the misdetection can be suppressed.

In this embodiment, as shown in FIG. 6B, the waste liquid foam 43 is configured so that the plurality of absorber sheets 48 are stacked. In this configuration, the waste liquid introduced from the waste liquid inlet portion 45 is less likely to penetrate into the absorber sheets 48 in the thickness direction, but is more likely to pass (flow) between each of the absorber sheets 48. Then, since the detection electrodes 51*a*, 51*b* make contact with the front-end surface 43*a*, of the waste liquid foam 43, which is one of side surfaces along a direction of stacking of the absorber sheets 48, the waste liquid absorbed into the waste liquid foam 43 can be reliably brought in contact with the detection electrodes 51*a*, 51*b*.

As shown in FIGS. 3 and 4, the ink-jet printer 1 of this embodiment is provided with the ink-jet head 26, the scanning section 22, various motors, etc., on the rear side of the printer housing 2. As a result, the center of gravity of the ink-jet printer 1 is shifted toward the rear side thereof. Therefore, when the ink-jet printer 1 is shipped from a factory, the ink-jet printer 1 is preferably to be transported in a state that the front surface portion, at which the install section 11 and the holder 15 are provided, is positioned in the upper direction. In this state, among the end surfaces of the waste liquid foam 43, the front-end surface 43*a* of the waste liquid foam 43 with which the detection electrodes 51*a*, 51*b* are in contact is disposed at the uppermost position. Further, when the ink-jet printer 1 is shipped from the factory, the waste liquid discharged from the ink-jet head 26 at the time of inspection before the ink-jet printer 1 is shipped is recovered into the waste liquid foam 43. Thus, the waste liquid foam 43 is not empty, and some ink is absorbed into the waste liquid foam 43. As described above, however, since the front-end surface 43*a* of the waste liquid foam 43 with which the detection electrodes 51*a*, 51*b* are in contact is disposed at the uppermost position in a posture when being shipped from the factory, the ink absorbed into the waste liquid foam 43 is less likely to flow into the detection electrodes 51*a*, 51*b* at the time of the transportation of the ink-jet printer 1.

Next, modified embodiments in which various modifications are made in this embodiment will be described below. The same reference numerals are assigned to components having the same structure as in the above embodiment, and the description of such components is appropriately omitted.

First Modified Embodiment

In the above embodiment, as shown in FIG. 6A, the waste liquid recover unit 40 is configured so that the detection electrodes 51*a*, 51*b* are brought in contact with the end surface of the waste liquid foam 43 by arranging the board 50 having the surface on which the detection electrodes 51*a*, 51*b* are formed to make contact with the end surface of the waste liquid foam 43. However, the present teaching is not limited thereto. For example, it may be configured so that the detection electrodes 51*a*, 51*b* are directly adhered on the end surface of the waste liquid foam 43. This configuration can be realized so that printing, deposition, or the like is used to form the electrode patterns of the detection electrodes 51*a*, 51*b* directly on the end surface of the waste liquid foam 43. As such, by adhering the detection electrodes 51*a*, 51*b* directly on the end surface of the waste liquid foam 43, the detection electrodes 51*a*, 51*b* are less likely to be separated from the waste liquid foam 43 even when the vibration acts on the ink-jet printer 1.

Second Modified Embodiment

The above embodiment is focused on the two factors causing the vibrations in the ink-jet printer 1: the movement of the carriage 25 and the opening/closing of the cover 3. In other words, vibration generating sources, which generate the vibrations in the left-right direction and the up-down direction to the waste liquid foam 43, are the carriage 25 and the cover 3, respectively. Here, the front-end surface of the waste liquid foam 43 is a surface which has no normal line in the left-right direction and the up-down direction, each of which is a vibration direction of the vibration generated in the waste liquid foam 43. Thus, there is adopted the configuration in which the detection electrodes 51*a*, 51*b* are brought in contact with the front-end surface 43*a* of the waste liquid foam 43. However, the end surface of the waste liquid foam 43 with which the detection electrodes 51*a*, 51*b* are in contact may change depending on the factor causing the vibration on which the attention is focused.

In a case that the attention is only necessary to be focused on the vibration at the time of the movement of the carriage 25, such as a case in which the cover 3 is light in weight and thus the impact at the time of the opening/closing of the cover 3 is small, a case in which the ink-jet printer 1 is not provided with the cover 3, and the like, the end surface of the waste liquid foam 43 with which the detection electrodes 51*a*, 51*b* are in contact may be a surface along the scanning direction (left-right direction) of the carriage 25. In this case, a configuration in which the detection electrodes 51*a*, 51*b* are brought in contact with an upper-end surface or a lower-end surface of the waste liquid foam 43 may be adopted.

On the contrary, for example, in a case that the vibration due to the impact generated when the cover 3 is opened/closed is very large and that the vibration generated when the carriage 25 is moved is sufficiently small, the attention may be only necessary to be focused on the vibration at the time of the opening/closing of the cover 3. Further, there has been conventionally known the ink-jet printer 1 provided with a line-type ink-jet head which does not move at the time of the recording of the image. In such a printer, the end surface of the waste liquid foam 43 with which the detection electrodes 51*a*, 51*b* are in contact may be a surface along the up-down direction as the rotating direction of the cover 3; and a configuration in which the detection electrodes 51*a*, 51*b* are brought in contact with the side surface (namely, left end surface, right end surface, or rear end surface), of the waste liquid foam 43, other than the front end surface 43*a* may be adopted.

Figure 8:
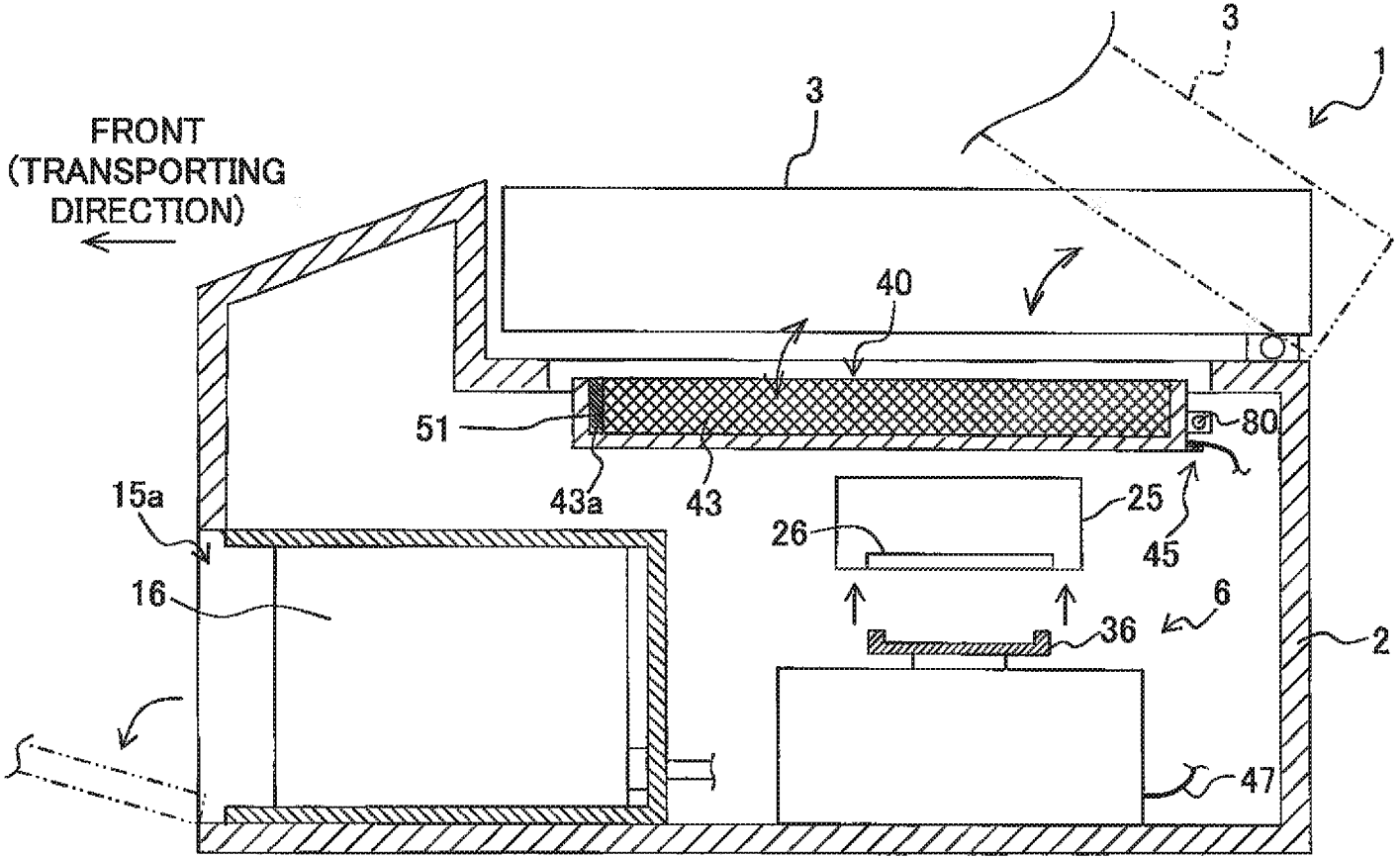
FIG. 8 is a cross-sectional view corresponding to FIG. 4, illustrating an ink-jet printer having a waste liquid recover unit which is rotatable around a rotational axis.

Alternatively, the attention may be focused on factors causing the vibration, other than the movement of the carriage 25 and the opening/closing of the cover 3. For example, as shown in FIG. 8, in a case that the waste liquid recover unit 40 is rotatably attached to the printer housing 2, the attention may be focused on the vibration generated when the waste liquid recover unit 40 itself is rotated. That is, the vibration generating source which vibrates the waste liquid foam may be a rotating mechanism which rotates the waste liquid recover unit 40 with respect to the printer housing 2.

In FIG. 8, the waste liquid recover unit 40 is disposed at a position over or above the waiting position of the ink-jet head 26 and is attached to the printer housing 2 to be rotatable up and down around a rotational axis 80. The waste liquid recover unit 40 is capable of changing positions thereof between a normal position (horizontal position shown in FIG. 8) at the time of recovering the waste liquid and a retracted position in which the waste liquid recover unit 40 is rotated upward from the normal position. As described above, in a case that the waste liquid recover unit 40 has the configuration such that the waste liquid recover unit 40 is rotated upward to be retractable, the maintenance such as exchange and repair can be performed more easily. In this configuration, the end surface of the waste liquid foam 43 with which the detection electrodes 51*a*, 51*b* are in contact may be a side surface parallel to the up-down direction as the rotating direction of the waste liquid recover unit 40. Noted that FIG. 8 shows an example in which the detection electrodes 51*a*, 51*b* make contact with the front-end surface 43*a*. By making the detection electrodes 51*a*, 51*b* come contact with the front-end surface 43*a*, the vibration which acts on the waste liquid foam 43 when the waste liquid recovery unit 40 is rotated in the up-down direction generates in a direction along the end surface with which the detection electrodes 51*a*, 51*b* are in contact. Thus, the detection electrodes 51*a*, 51*b* are less likely to be separated from the waste liquid foam 43.

Further, in FIG. 8, the front-end surface 43*a* of the waste liquid foam 43 with which the detection electrodes 51*a*, 51*b* are in contact is an end surface which is disposed at the uppermost position among the end surfaces of the waste liquid foam 43 when the waste liquid recover unit 40 is rotated upward to be the retracted position. Therefore, in a case that the waste liquid recover unit 40 is in the retracted position, the waste liquid is less likely to pass through the gap between the waste liquid case 44 and the waste liquid foam 43, and thus the waste liquid is less likely to flow toward the detection electrodes 51*a*, 51*b*.

Figure 9:
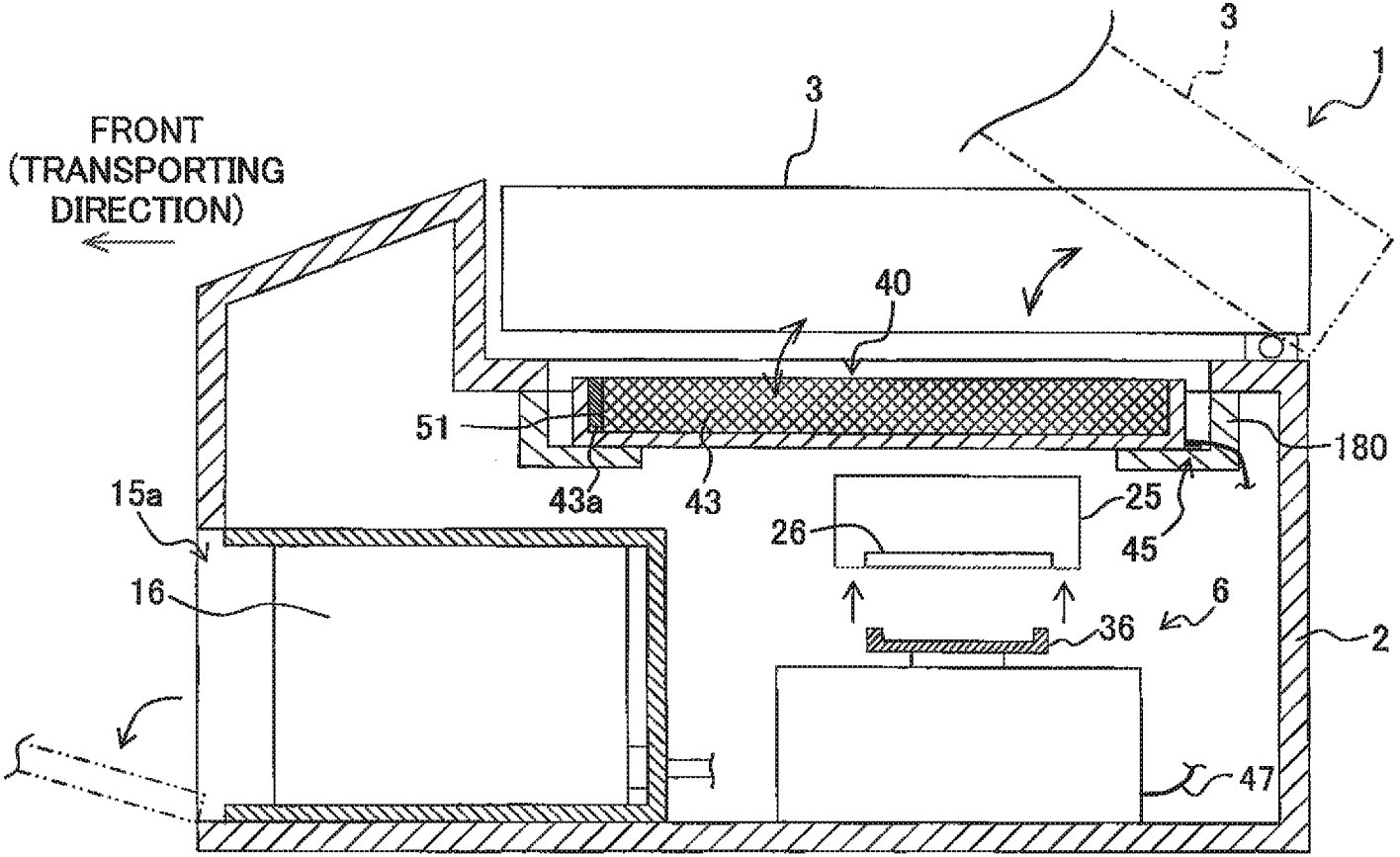
FIG. 9 is a cross-sectional view corresponding to FIG. 4, illustrating an ink-jet printer having a waste liquid recover unit which is slidable along a rail.

For example, as shown in FIG. 9, when the waste liquid recover unit 40 is slidably attached to the printer housing 2, the attention may be focused on the vibration generated when the waste liquid recover unit 40 itself is moved in a sliding manner. That is, the vibration generating source which vibrates the waste liquid foam may be a sliding mechanism which moves the waste liquid recover unit 40 in a sliding manner with respect to the printer housing 2.

As shown in FIG. 9, the waste liquid recover unit 40 is arranged above the waiting position of the ink-jet head 26. A pair of rails 180 extending in the scanning direction of the carriage 25 (a direction perpendicular to the paper surface in FIG. 9) is formed in the printer housing 2, and the waste liquid recover unit 40 is provided on the rails 180 so that the waste liquid recover unit 40 is slidable on the rails 180. When the waste liquid is recovered, the liquid recover unit 40 is arranged above the waiting position of the ink-jet head 26, as shown in FIG. 9. When the user gets access to the ink-jet head 26 located at the waiting position, the user can move the waste liquid recover unit 40 in the scanning direction along with the rails 180 so that the waste liquid recover unit 40 is retracted from the position above the ink-jet head 26.

Vibrations are generated in the waste liquid recover unit 40, when the waste liquid recover unit 40 in a resting state starts to slide, and when the waste liquid recover unit 40 in a sliding state starts to stop. A direction of the vibrations acting on the waste liquid foam 43 is substantially parallel to the moving direction of the waste liquid recover unit 40 (the scanning direction of the carriage 25). In such a configuration, the end surface of the waste liquid foam 43 contacting with the detection electrodes 51*a*, 51*b* can be parallel to the scanning direction. In FIG. 9, an example in which the detection electrodes 51*a*, 51*b* make contact with the front-end surface 43*a* is shown. By making the detection electrodes 51*a*, 51*b* come contact with the front-end surface 43*a*, the vibration which acts on the waste liquid foam 43 when the waste liquid recovery unit 40 is moved in the scanning direction generates in a direction along the end surface with which the detection electrodes 51*a*, 51*b* are in contact. Therefore, the detection electrodes 51*a*, 51*b* are less likely to be separated from the waste liquid foam 43.

Third Modified Embodiment

Figure 7:
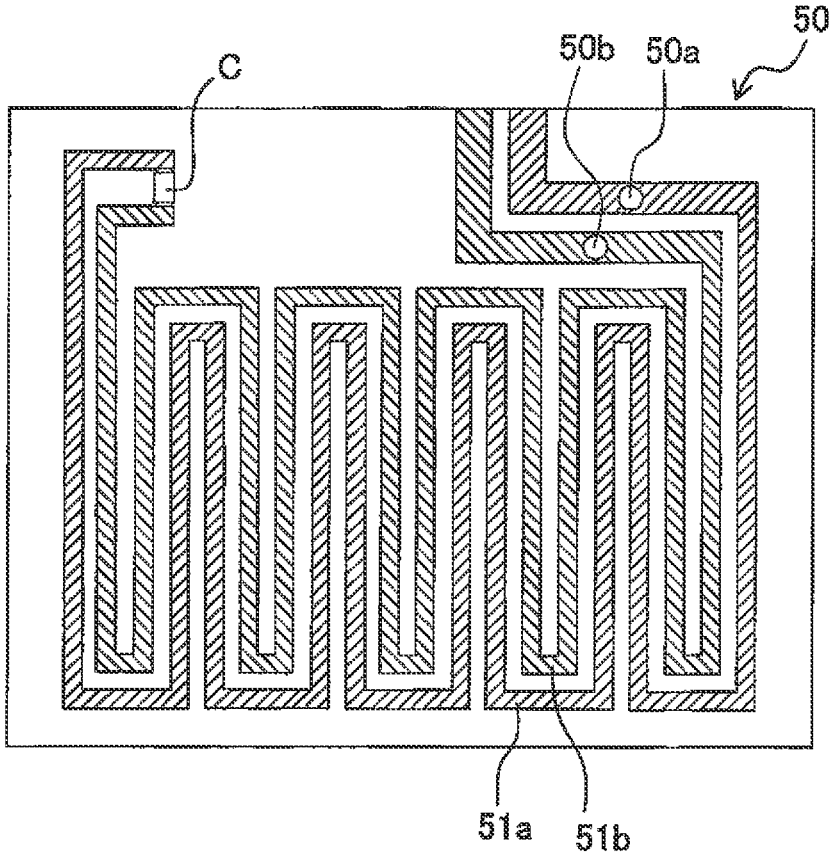
FIG. 7 is a plan view of a board of a waste liquid detection sensor.

The detection electrodes 51*a*, 51*b* of the waste liquid amount detection sensor 42 are not limited to the electrode patterns as shown in FIG. 7. For example, as shown in FIG. 9, the detection electrodes 51*a*, 51*b* may be formed as electrode patterns, each of which is in a so-called comb teeth shape and is provided with one of a plurality of electrodes 52*a*, 52*b*. The electrodes 52*a*, 52*b* are alternately arranged along the end surface of the waste liquid foam 43.

Fourth Modified Embodiment

In the above embodiment, as an example in which the waste liquid recover unit 40 recovers the waste liquid, the recovery of the waste liquid discharged when the suction purge executed by the cap member 36 and the suction pump 37 is performed is cited. However, the waste liquid recover unit 40 is not limited to recover the waste liquid generated by the suction purge, but may recover the waste liquid generated by various operations of the ink-jet printer 1 other than the suction purge. For example, the waste liquid recover unit 40 may recover the waste liquid generated by a flushing of the nozzles 31 of the ink-jet head 26.

Figure 10:
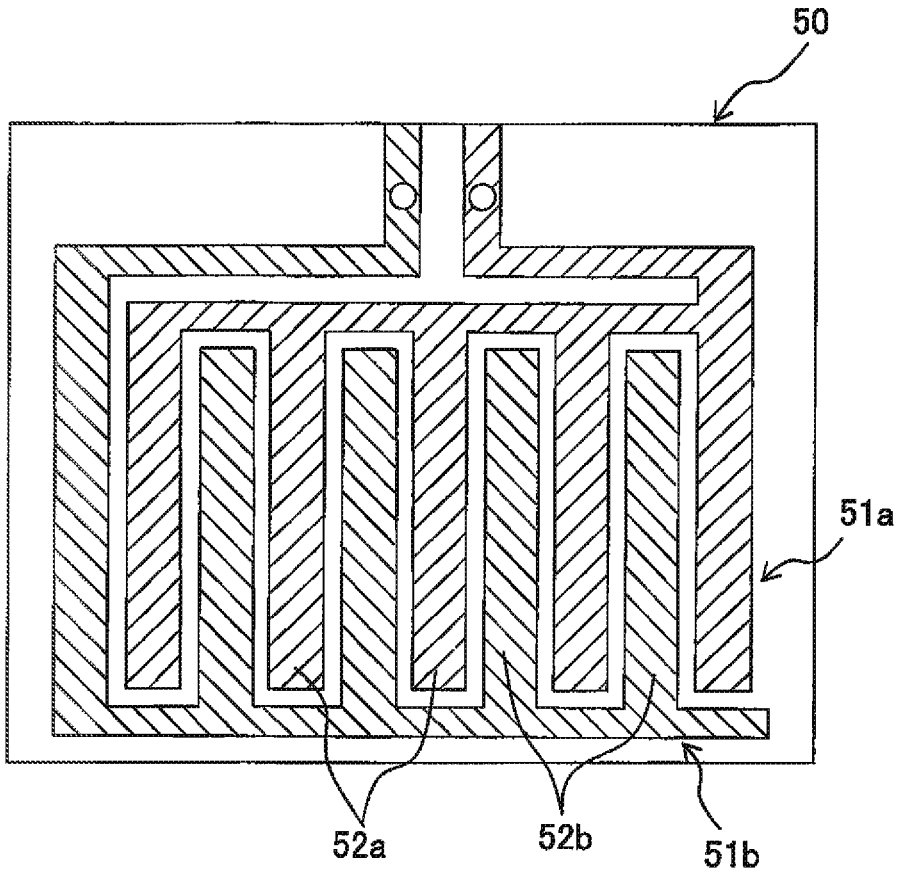
FIG. 10 is a plan view of a board of a waste liquid detection sensor according to another modified embodiment.
Figure 11:
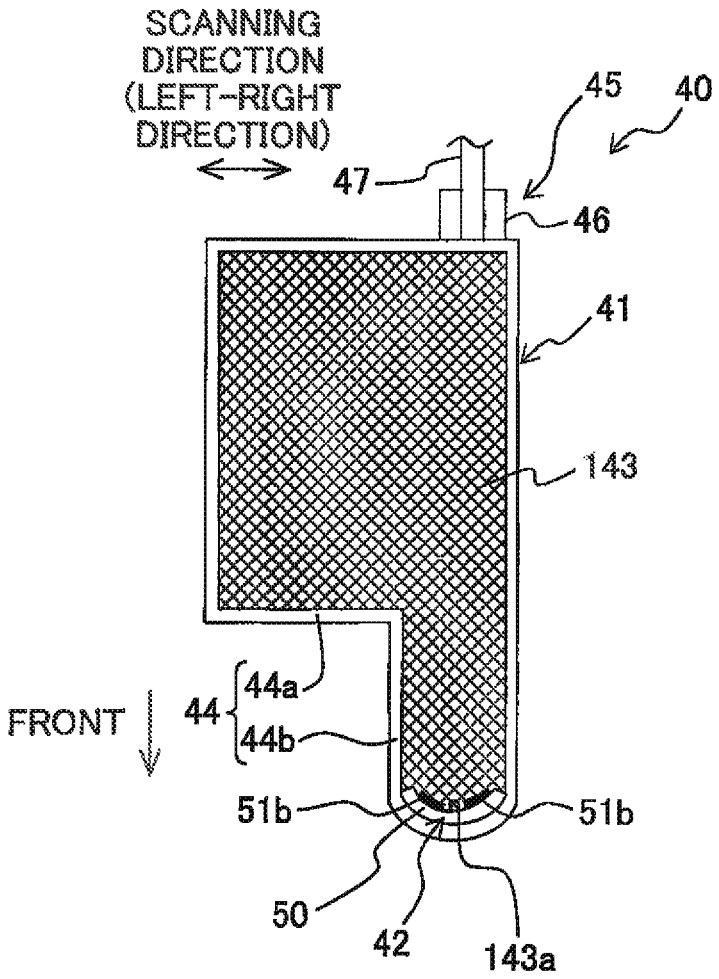
FIG. 11 shows a view corresponding to FIG. 6A, illustrating a waste liquid recover unit provided with a waste liquid foam having an end surface in a curved shape.

In the embodiment and the modified embodiments, the detection electrodes are disposed to make contact with the planar end surface of the waste liquid foam. However, the present teaching is not limited thereto. In a case that the waste liquid foam has a curved end surface, and that a normal direction of the curved end surface is not coincident with the vibration direction, then the detection electrodes can be arranged to make contact with the curved end surface of the waste liquid foam. For example, as shown in FIG. 10, in a waste liquid foam 143 provided with an end surface 143*a* having a curved shape at the front portion thereof, the detection electrodes 51*a*, 51*b* can be arranged at the end surface 143*a* having the curved shape.

The above description is made by citing the carriage 25, the cover 3, and the rotating mechanism which rotates the waste liquid recover unit 40 with respect to the printer housing 2, as examples of the vibration generating source which generates the vibration in the waste liquid foam. The vibration generating source of the present teaching is not necessarily limited to thereto; and it is possible to adopt a vibration generating source having any structure. Further, the vibration generating source does not necessarily vibrate the waste liquid foam only in one direction; and a direction of a vibrational component, among the vibrational components generated in the waste liquid foam, which vibrates the waste liquid foam with the largest amplitude, is let to be a vibration direction in the present teaching.

The embodiment and the modified embodiments thereof described above are the examples in which the present teaching is applied to the inkjet printer which is one of liquid droplet jetting apparatuses and which jets the ink. However, the application objective of the present teaching is not limited thereto. That is, the present teaching is applicable irrelevant to the type of the liquid to be jetted, the way of use, and the technical field in which the present teaching is used.

What is claimed is:

1. A liquid jetting apparatus which jets liquid onto a medium comprising:

a liquid jetting head configured to jet the liquid;

a liquid discharge unit configured to discharge the liquid from the liquid jetting head;

a waste liquid recover unit including a waste liquid absorber configured to absorb a waste liquid discharged from the liquid jetting head by the liquid discharge unit and detection electrodes configured to detect a waste liquid amount absorbed into the waste liquid absorber; and a vibration generating source configured to vibrate the waste liquid absorber in a vibration direction;

wherein the detection electrodes are disposed to make contact with an end surface defining the waste liquid absorber, and a normal direction of the end surface intersects with the vibration direction;

wherein the vibration generating source includes a head driving mechanism configured to move the liquid jetting head in a scanning direction;

wherein the vibration direction includes a component parallel to the scanning direction; and wherein the detection electrodes are brought in contact with an end surface, of the waste liquid absorber, which is along the scanning direction.

2. The liquid jetting apparatus according to claim 1, further comprising:

a housing configured to accommodate the liquid droplet jetting head;

wherein the vibration generating source further includes a cover which is rotatably attached to the housing; and wherein the end surface, of the waste liquid absorber, with which the detection electrodes are in contact, is an end surface which is also along a rotating direction of the cover.

3. The liquid jetting apparatus according to claim 1; further comprising:

a housing configured to accommodate the liquid jetting head;

wherein the liquid discharge unit configured to discharge the liquid from the liquid jetting head and the waste liquid recover unit are disposed above the liquid jetting head;

wherein the vibration generating source includes a moving mechanism which is configured to move the waste liquid recover unit in a moving direction relative to the housing;

wherein the waste liquid recover unit is configured to be retractable so that the waste liquid recover unit is moved by the moving mechanism to be separated from the liquid jetting head; and wherein the detection electrodes are brought in contact with an end surface, of the waste liquid absorber, which is parallel to the moving direction.

4. The liquid jetting apparatus according to claim 3;

wherein the moving mechanism includes a rotating mechanism configured to rotate the waste liquid recover unit in an up-down direction relative to the housing; and wherein the detection electrodes are brought in contact with an end surface, of the waste liquid absorber, which is parallel to the up-down direction.

5. The liquid jetting apparatus according to claim 3;

wherein the detection electrodes are brought in contact with the end surface which is disposed at the uppermost position in a case that the waste liquid recovery unit is rotated upward to be a retracted position.

6. The liquid jetting apparatus according to claim 1;

wherein the detection electrodes are formed on a surface of an insulating board; and wherein the insulating board is arranged parallel to an end surface of the waste liquid absorber in a state that the detection electrodes are brought in contact with the end surface.

7. The liquid jetting apparatus according to claim 1;

wherein the detection electrodes are directly adhered on an end surface of the waste liquid absorber.

8. The liquid jetting apparatus according to claim 1;

wherein the detection electrodes are constructed of two electrodes having electrode patterns which are arranged alternately along the end surface of the waste liquid foam with which the detection electrodes are in contact.

9. The liquid jetting apparatus according to claim 1;

wherein the waste liquid absorber includes a plurality of absorber sheets in a stacked state; and wherein the end surface, of the waste liquid absorber, which makes contact with the detection electrodes, is parallel to a direction of stacking of the absorber sheets.

10. The liquid jetting apparatus according to claim 1;

wherein the waste liquid recover unit includes a waste liquid inlet portion configured to introduce the waste liquid into the waste liquid absorber from the liquid discharge unit; and wherein the waste liquid inlet portion is disposed on a side of an end surface, of the waste liquid absorber, which is opposite to the end surface with which the detection electrodes are in contact.

11. The liquid jetting apparatus according to claim 1;

wherein the detection electrodes are disposed to come contact with the end surface having a curved shape.

12. A liquid jetting apparatus which jets liquid onto a medium comprising:

a liquid jetting head configured to jet the liquid;

a liquid discharge unit configured to discharge the liquid from the liquid jetting head;

a waste liquid recover unit including a waste liquid absorber configured to absorb a waste liquid discharged from the liquid jetting head by the liquid discharge unit and detection electrodes configured to detect a waste liquid amount absorbed into the waste liquid absorber;

a vibration generating source configured to vibrate the waste liquid absorber in a vibration direction; and a housing configured to accommodate the liquid jetting head;

wherein the detection electrodes are disposed to make contact with an end surface defining the waste liquid absorber and a normal direction of the end surface intersects with the vibration direction;

wherein the vibration generating source includes a cover which is rotatably attached to the housing;

wherein the cover and the housing are arranged side by side in one direction;

wherein the vibration direction includes a parallel-component parallel to the one direction; and wherein the detection electrodes are arranged so that the detection electrodes are brought in contact with an end surface, of the waste liquid absorber, which is along the one direction.

* * * * *